United States Patent [19]

Legeay et al.

[11] 3,991,293

[45] Nov. 9, 1976

[54] SWITCH FOR HIGH-FREQUENCY CURRENTS, HAVING MODULAR CONSTRUCTION

[75] Inventors: René Legeay, Paray Vieille Poste; Jöel Jamet, Paris; Louis Benassi, Juvisy-sur-Orge, all of France

[73] Assignee: Compagnie Industrielle des Telecommunications Cit-Alcatel, Paris, France

[22] Filed: Mar. 4, 1975

[21] Appl. No.: 555,310

[30] Foreign Application Priority Data

Mar. 4, 1974 France ..... 74.07298

[52] U.S. Cl. ..... 200/153 S; 200/307

[51] Int. Cl.[2] ..... H01H 63/00

[58] Field of Search ..... 200/153 S, 153 T, 303, 200/307

[56] References Cited

UNITED STATES PATENTS 3,873,794 3/1975 Owen ..... 200/153 S

*Primary Examiner*—Herman J. Hohauser

*Attorney, Agent, or Firm*—Sughrue, Rothwell, Mion, Zinn and Macpeak

[57] ABSTRACT

The invention comes within the field on *n*-way pole switches intended more particularly for the switching of high-frequency currents. It concerns a switch formed by the assembly of individual modules containing a micro-relay whose make contact ensures the selection of a determined direction. The modular switch according to the invention is used to great advantage in automatic control stations.

5 Claims, 6 Drawing Figures

SWITCH FOR HIGH-FREQUENCY CURRENTS, HAVING MODULAR CONSTRUCTION

The invention has as its object an $n$-way switch, constituted by the combining together of modular units which are identical to one another, each of which, containing a small relay having an incorporated make contact, constitutes a cut-out point. The modular switch is constituted, to great advantage, by the alining of several modules side by side in the form of a compact block. Due to the small dimensions of the individual module, the compact modular switch may readily be used for the directing of a high-frequency current: more particularly, it may be equipped with coaxial cables at the input and at the outputs and then provides a switch having a completely coaxial structure, practically without any impedance break and with a very slight reflection coefficient, even at frequencies reaching 10 Mc/s.

Switches having a coaxial structure, comprising a stator provided with $n$ coaxial sockets a rotor ensuring the interconnection of a coaxial input with one of the $n$ output sockets, according to its position, are known. Such devices, which require precision machining, are expensive and constitute a rigid structure assembly.

The invention provides a much more versatile solution, making it possible to vary at will the number of output directions by grouping together the necessary number of modules. It applies either to coaxial switching, with $n$ modules for $n$ directions, or to the switching of a symmetrical pair, with $2n$ modules for $n$ directions.

The invention uses a micro-relay, known per se, having the form of a small bulb presenting two terminals alined on either side of the bulb and between which a "wet" contact is provided by a drop of mercury which forms the galvenic continuity between the two terminals under the effect of the expanding of a gas contained in the bulb, heated by the passing of an electric control current in a filament.

According to the invention, a module contains a cylindrical recess for the micro-relay and, on either side of the relay, two cylindrical recesses in a cross-configuration with the first recess for the passing of an insulated input wire and of an insulated output wire, respectively, and is in the form of a small parallelepipedical block constituted by the joining together of two identical halves each containing two semi-cylindrical spouts in a cross-configuration. A single-pole $n$-way modular switch comprises in the case of the coaxial structure, a compact assembly of $n$ aligned modules, whose input wires are connected up at a common point to the central wire of a coaxial input cable. Such a modular switch comprises in the case of a symmetrical structure, 2 $n$ modules $n$ of which, each relating to a different direction, have their input wires connected up in common to one of the two connectors of a symmetrical pair and the $n$ others have their wires connected up in common to the other of the two connectors of the symmetrical pair.

The invention will be described in detail with reference to the accompanying drawings, among which:

Figure 1:
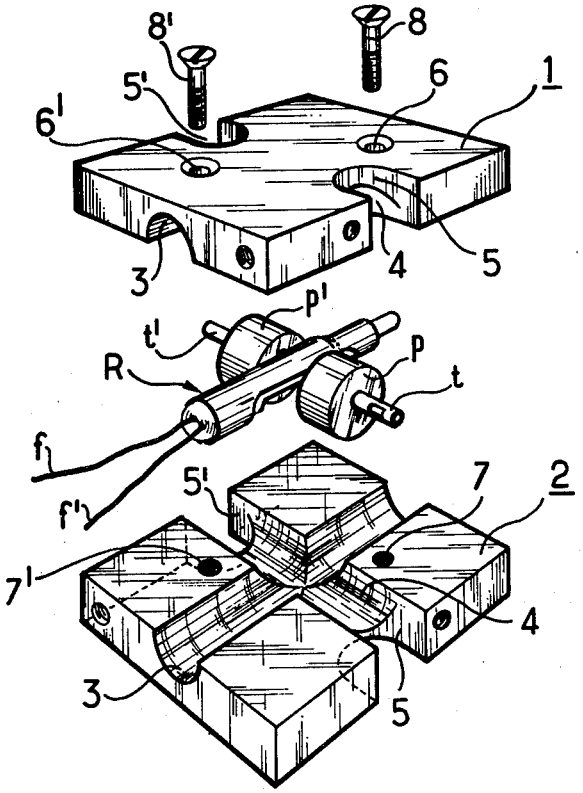
FIG. 1 is a perspective exploded view of a module according to the invention.

FIG. 1 - A module comprises two halves having a parallelepipedical shape, 1, 2, preferably made of a light alloy, having a general identical structure. Each contains two spouts having a semi-circular cross-section, with a cross-configuration, which can be seen at 3 and 4 on the lower half. One of the spouts, 3, crosses right through; the other, 4, leads out, at each end, into a groove with a semi-circular bottom, 5, 5'.

A micro-relay R, with two terminal rods $t$, $t'$, on either side, surrounded each with a cylindrical bead $p$, $p'$ having slight losses, and provided with wires $f, f'$, for the control feeding electric current, can be seen between 1 and 2.

Each half is provided with holes for the connecting together of the two halves into a small "block", such as the milled holes 6, 6' for the half 1, tapped holes 7, 7' for the half 2, which can have screws 8, 8' fitted into them. Each half contains, on each lateral face, a tapped hole, not referenced, to have a solder lug contingently fitted into it.

Figure 2:
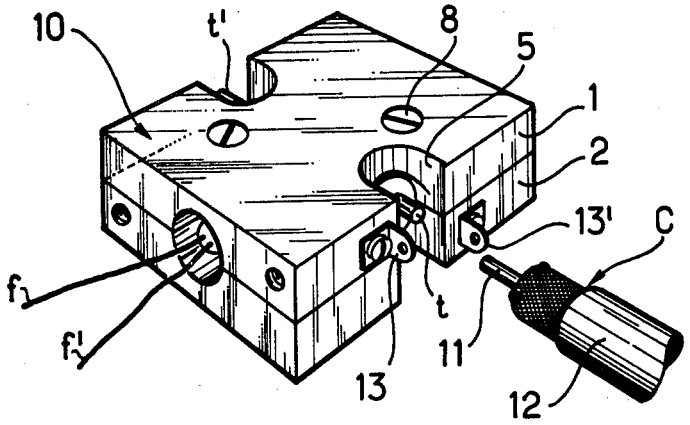
FIG. 2 is a perspective view of an assembled module, which can be connected to a coaxial cable.

FIG. 2 — FIG. 2 shows a module assembled in the form of a "block", 10, whence emerge the wires $f, f'$, containing the relay R, not visible and on which the internal conductor 11 of a coaxial cable C is made ready to be connected up to the terminal rod $t$ of the relay. The metallic tress 12 of the cable C will be welded to two lugs 13, 13' screwed into the halves 1, 2, respectively.

Figure 3:
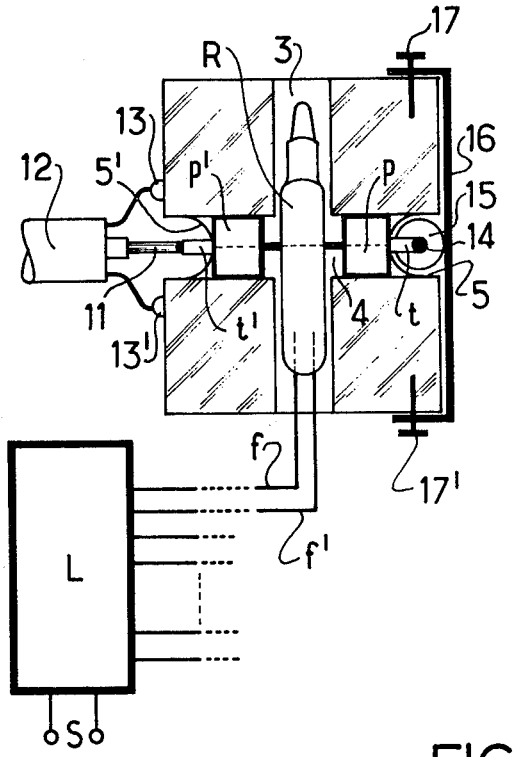
FIG. 3 is a view of a half module forming a part of a modular switch having a coaxial structure.

FIG. 3 — FIG. 3 is a partly cutaway view of a module taken from among several modules of a modular switch. The connection rod $t'$ of the left-hand relay, leaving the bead $p'$, is welded to the internal conductor 11 of a coaxial output cable. The right-hand rod $t$, leaving the bead $p$, is welded to a wire 14 which is shown in a cross-section, leaving an insulating bead 15, having the same shape as the beads $p$, $p'$. The groove 5 which is engaged over a part of its length by the bead 14 is closed on the outside by a metallic hood 16 held by screws 17, 17'. The hood 16 closing the recess imparts to it a coaxial structure.

All the relay control wires of the various modules constituting the modular switch can be connected to a logic unit L, which connects a control current source S to the required individual relay according to a pre-established programme, which can be applied by a computer, as in current practice in modern control stations.

Figure 4:
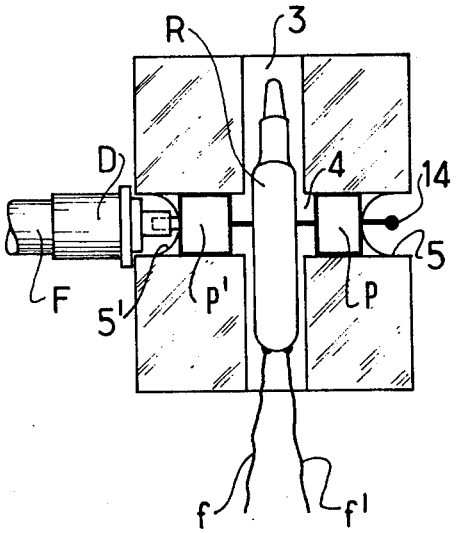
FIG. 4 is a variant of the assembly according to FIG. 3.

FIG. 4 — FIG. 4 is a variant of the assembly according to FIG. 3, in which the coaxial connections are made by a coaxial pin F and a coaxial socket D of standard type fixed permanently onto the module.

Figure 5:
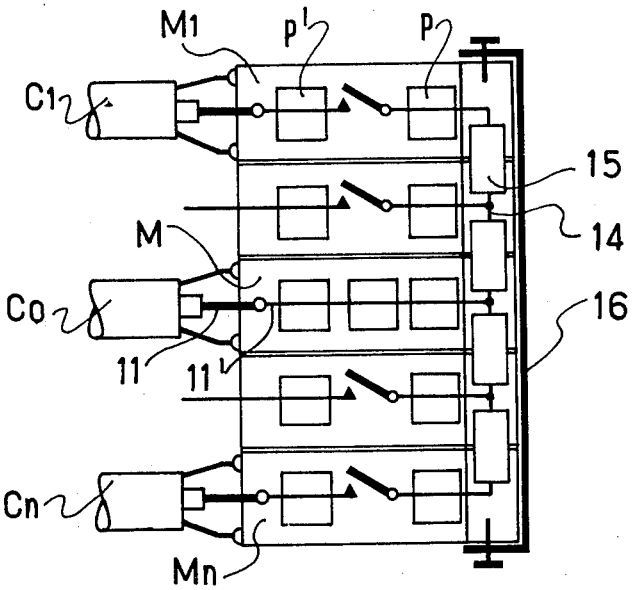
FIG. 5 is a diagrammatic view of a modular switch having a coaxial structure.

FIG. 5 — FIG. 5 shows in a diagrammatic way a modular $n$-way coaxial switch, where $n = 4$. The references have the same significance as in FIG. 3.

Four modules M1 to M4, corresponding to the four coaxial structure output directions, are shown (only two output cables C1 and C4 have been drawn in the figure). The wire 14, which connects all the relay terminals which are on a same side, is placed in a coaxial recess, as has been explained with reference to FIG. 3 and as is more clearly apparent here.

The input of the coaxial switch is shown by a coaxial cable Co, whose central wire 11 is connected to the wire 14 through a block M having a simplified structure, not comprising any relay R but simply a wire 11', insulated by beads similar to the beads 15.

It will be observed that the coaxial input cable Co, instead of being connected up on the same side as the output cables could be connected up on the opposite side.

Figure 6:
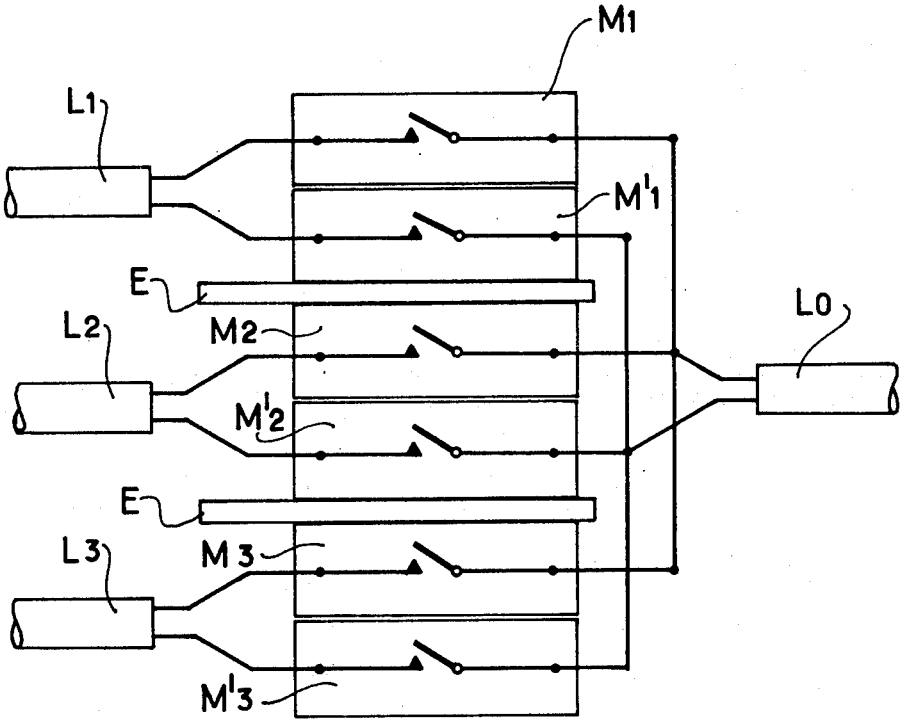
FIG. 6 is a diagrammatic view of a modular switch having a symmetrical structure.

FIG. 6 — FIG. 6 shows diagrammatically a modular switch according to the invention for symmetrical lines.

In the figure, it has been assumed that there were, for an input line Lo, three possible output lines L1, L2, L3.

In that case, for each output direction, there must be two modules, one for each wire namely, M1, M'1, M2, M'2, M3, M'3.

To avoid any cross-talk, a metallic screen E is, to great advantage, placed between two neighbouring modules corresponding to different outputs: between M'1 and M2, between M'2 and M3, etc.

The switch according to the invention has the advantage of making it possible to constitute, by the simple assembling of identical modules, switches, more particularly coaxial switches, having any number of directions, adjustable on request, having a substantially integrally coaxial structure, capable of ensuring, without appreciable wear, several tens of millions of switching operations. It may be used more particularly, to program automatic check operations controlled by a computer.

We claim:

1. A modular multiple-way microswitch assembly for selectively switching high frequency signals from an input terminal to a plurality of output terminals, said assembly comprising:

a. a plurality of microswitch modules, each of which comprises:

1. a light alloy casing block having first and second internal channels of circular cross-section and intersecting at right angles at the center of said block;

2. a tubular microswitch disposed longitudinally within said first channel and having first and second external switch leads extending transversely outwardly in opposite directions from the center of said block and through the opposite ends, respectively, of said second channel; said microswitch having control lead means extending from one end of said first channel for selectively opening and closing the microswitch in response to control signals;

3. a circular insulating bead mounted in each of said opposite ends of said second channel for supporting the corresponding external switch lead; and b. conductor means connecting the assembly input terminal in common to the first external switch leads of all of said modules; said modules being stacked upon each other so that the axes of corresponding channels in the modules are parallel, and so that the second external switch leads form said plurality of output terminals of said assembly; whereby the high frequency signals appearing on said input terminal of said assembly are selectively switched to said output terminals in accordance with the control signals applied to the control lead means of the microswitches.

2. A modular microswitch assembly as defined in claim 1 wherein each casing block is rectangular and has a semicircular groove extending across the center of one edge of the block at the opposite end of said second channel through which said first external switch lead extends, the blocks being stacked so that all of the first external switch leads are on the same side of the assembly and so that the grooves in all of the blocks are aligned to form a single continuous groove, said conductor means comprising a wire insulatingly supported in said continuous groove and electrically connected to the assembly input terminal and to the first external switch leads of all of the microswitches.

3. A modular microswitch assembly as defined in claim 2 wherein said input and output terminals are provided with means for connecting them to coaxial input and output cables, respectively; and further comprising a U-shaped metallic hood covering said continuous groove so as to impart to said wire a coaxial configuration, and a plurality of insulating beads spaced along said continuous groove for supporting said wire.

4. A modular microswitch assembly as defined in claim 3 further comprising an input module stacked with said microswitch modules to form said assembly, said input module containing said input terminal and said means for connecting said input terminal to a coaxial input cable.

5. A modular microswitch assembly as defined in claim 1 comprising conductive screens inserted between adjacent pairs of said modules.

* * * * *